United States Patent [19]

Storchi

[11] Patent Number: 5,027,760

[45] Date of Patent: Jul. 2, 1991

[54] VARIABLE TIMING SYSTEM FOR ENGINE VALVE OPERATING GEAR

[76] Inventor: Franco Storchi, Via Garibaldi, 50 - 42017, Novellara (Reggio Emilia), Italy

[21] Appl. No.: 415,249

[22] PCT Filed: Sep. 2, 1988

[30] Foreign Application Priority Data

Jan. 19, 1988 [IT] Italy ..... 3306 A/88

[51] Int. Cl.[5] ..... F01L 1/34

[52] U.S. Cl. ..... 123/90.16; 123/90.27

[58] Field of Search ..... 123/90.15, 90.16, 90.27

[56] References Cited

U.S. PATENT DOCUMENTS

| | | | |
|---|---|---|---|
| 3,911,879 | 10/1975 | Altmann | 123/90.31 |
| 4,205,634 | 6/1980 | Tourtelot, Jr. | 123/90.16 |
| 4,469,056 | 9/1984 | Tourtelot, Jr. et al. | 123/90.16 |
| 4,502,426 | 3/1985 | Skelley | 123/90.27 |
| 4,572,118 | 2/1986 | Baguéna | 123/90.16 |
| 4,901,684 | 2/1990 | Wride | 123/90.16 |

[86] PCT No.: PCT/JP79/00271

§ 371 Date: Aug. 22, 1989

§ 102(e) Date: Aug. 22, 1989

[87] PCT Pub. No.: WO89/06743

PCT Pub. Date: Jul. 27, 1989

FOREIGN PATENT DOCUMENTS

| | | | |
|---|---|---|---|
| 3213565 | 10/1983 | Fed. Rep. of Germany . | |
| 2570123 | 3/1986 | France . | |
| 459301 | 9/1950 | Italy | 123/90.16 |
| 0123707 | 6/1986 | Japan | 123/90.16 |
| 169250 | 11/1959 | Sweden | 123/90.16 |

*Primary Examiner*—David A. Okonsky
*Assistant Examiner*—Weilun Lo
*Attorney, Agent, or Firm*—Dvorak and Traub

[57] ABSTRACT

The system features an assembly of components for each inlet and/or exhaust valve or set of valves that comprises a moving control finger inserted between the surface of the cam and a generously proportioned flat surface offered by the tappet or pushrod. Each such finger is capable of longitudinal movement between these two surfaces, engaging with them through lines of contact disposed parallel to the camshaft, whereas the center about which it rotates is made to describe a curved or flat trajectory, offset to one side from the cam and the flat surface.

7 Claims, 4 Drawing Sheets

FIG.1
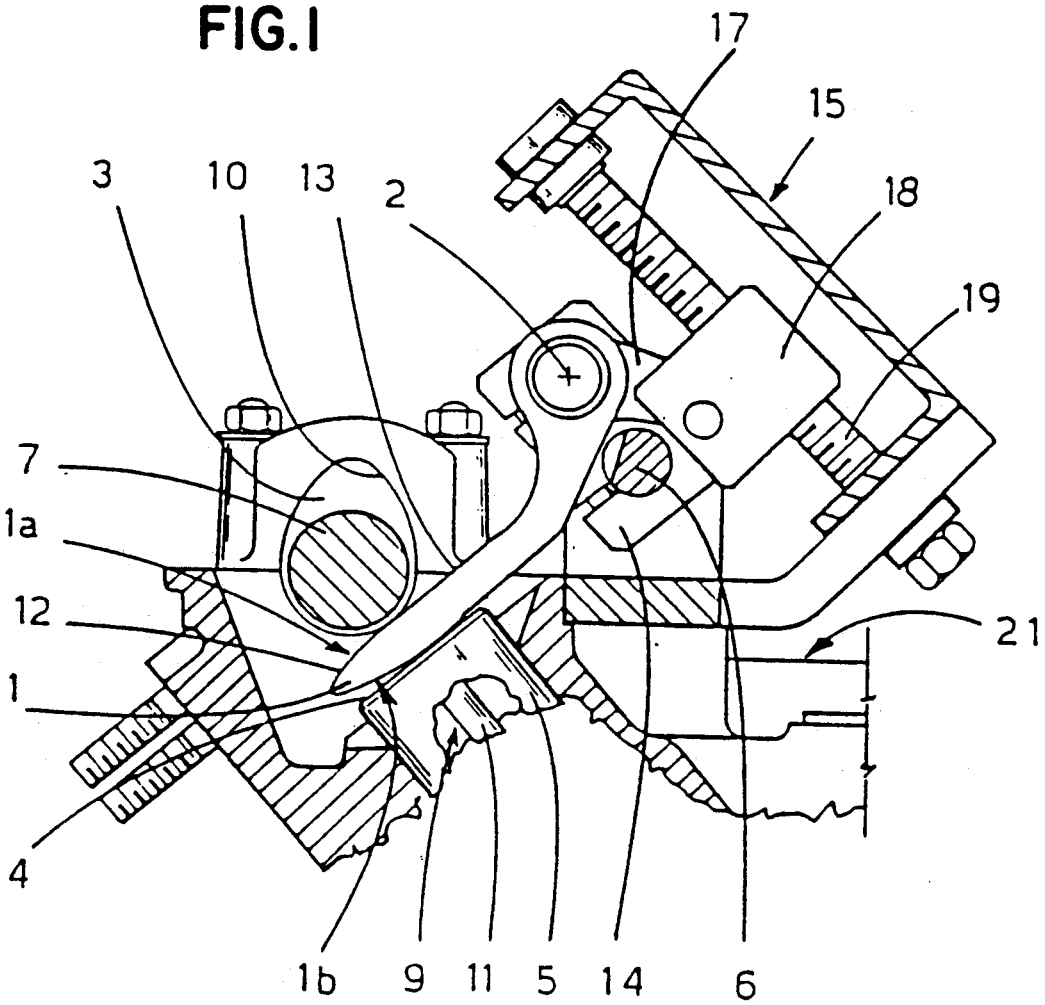
FIG.2
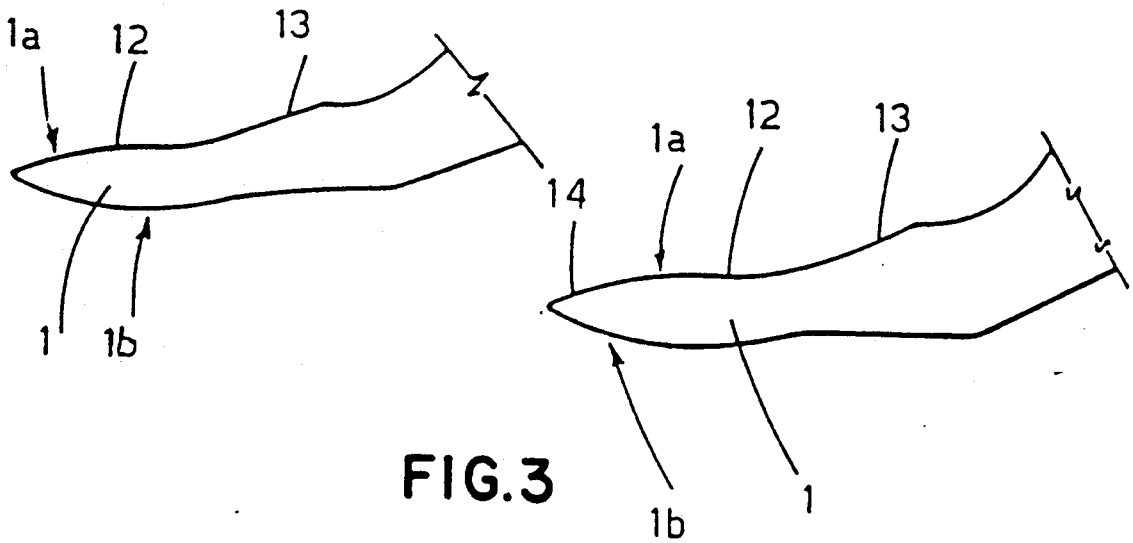
FIG.3

VARIABLE TIMING SYSTEM FOR ENGINE VALVE OPERATING GEAR

The invention relates to a variable timing system for the valve-gear of an engine, and in particular, of an internal combustion engine.

BACKGROUND OF THE INVENTION

It is common knowledge for a person skilled in the art that the design of an engine, say, an internal combustion engine, involves taking account of the normal conditions in which the engine operates. For example, the designer must know beforehand what will be the speed, i.e. the number of revolutions per minute, at which the engine is likely to be run for the greater part of the time.

In the case of high performance engines, operation will be mostly at maximum revs, whereas the engine of a standard production vehicle will be utilized at all speeds across its specified range, with the greater part of the time spent at a running speed (rev/min) somewhere between idling and maximum. This difference in requirements alone will dictate differences in the size and shape of the inlet and exhaust valves, and of their relative passages and lift cams.

High performance engines require valves and passages of given dimensions, and the valves must be able to remain open for relatively long intervals of time. With the high running speed of these engines, the air-fuel mixture and the exhaust gases generate such high levels of kinetic energy that mixture continues to enter the cylinder, and exhaust gases to exit, even during the compression and induction strokes, respectively. This action is also favored by the limited velocity of the piston at its top and bottom dead centers.

Conversely, when a high performance engine runs at low revs, the fluid, whether fuel mixture or exhaust gas, develops insufficient kinetic energy to offset the movement of the piston, and is thrust back into the relative passage, the result being a loss of volumetric efficiency. Volumetric efficiency is the ratio between the effective weight of fuel mixture admitted into the cylinder per unit of time, and that which would in theory fill the swept volume in the same unit of time at s.t.p., that is, with the identical cylinder temperature and inlet pressure conditions. In short, volumetric efficiency provides an index to the cylinder's correct replenishment. The current state of the art admits of proportioning the valves and passages and the cams that control the opening and closing movements of the valves, according to operating conditions, so as to obtain given volumetric efficiency, maximum output torque and power characteristics; however, such proportions are essentially fixed, and can only be altered by replacing or modifying the parts in question.

Volumetric efficiency can be varied by modifying the design of the inlet and exhaust passages and setting the opening and closing time lapses of the valves to given durations. Modifying the design of the inlet and exhaust passages necessarily involves altering the dimensions of the valves, and accordingly, extra power can be extracted from an engine by enlarging the valves and thus increasing the amount of fluid that enters or leaves the cylinder per unit of time. Such a step produces increased volumetric efficiency and higher maximum output torque, but also dictates that maximum torque, and maximum power, will occur at higher respective running speeds.

On the practical level, this type of modification involves removing and machining the cylinder head, and refitting it with the bigger valves mentioned. Such modifications are quite simple to implement, but are costly and signify immobilizing the vehicle for some considerable time. Even a modification of the amount of cam lift involves a lengthy standstill in the workshop for replacement, at very least, of the camshaft.

Conventionally then, engines are designed to power and torque specifications in which maximum output occurs at the running speed likely to be reached for the greater part of the time when in use. Clearly, this signifies that optimum volumetric efficiency is unobtainable at low and high running speeds, and the same must also apply for general performance.

In practice, the higher the maximum power and torque output specifications, the higher will be the speed at which the engine has to run; similarly, the lower the running speeds at which maximum power and torque are generated, the harder it becomes for the engine to reach high running speeds.

Accordingly, the object of the present invention is to overcome the drawbacks mentioned, and to permit of varying the power and torque characteristics of an engine swiftly and economically.

SUMMARY OF THE INVENTION

The stated object is realized with a variable timing system for valve-operating gear as characterized in the appended claims; the system features an assembly of components for each valve that comprises a moving control finger, positioned between the surface of the cam and a flat surface offered by the relative tappet or push-rod, and capable of longitudinal movement between the two surfaces; contact is made between the control finger and the two surfaces through lines parallel to the camshaft.

The profile of the single finger exhibits a section of increasing width that extends at least through a given stretch, departing from the end of the finger lodged between the two surfaces, and merges with a terminal section capable of restoring tip clearances which may become modified by the action of the lever that operates the control finger.

One of the advantages of the invention consists essentially in the facility of increasing volumetric efficiency at a given running speed by modifying the valve lift characteristic at that speed.

Another advantage of the system is that volumetric efficiency can be increased at any given running speed by utilizing a fully automatic control medium. A further advantage of the invention is that it can be applied to engines already in service. In this type of situation, the cost of fitting the system is comparable to that of replacing the existing valves with bigger ones; once fitted however, the economic advantages are comparable to those provided by an engine with the system designed in at the outset. Yet another advantage is that valve lift adjustments can be effected with the engine running, given that such an adjustment involves no more than moving the control fingers back or forward between the cams and the flat surfaces of the tappets or push-rods.

BRIEF DESCRIPTION OF THE DRAWINGS

The invention will now be described in detail, by way of example, with the aid of the accompanying drawings, in which:

FIG. 1 illustrates an engine fitted with the system according to the invention, viewed in a section transverse to the camshaft and with certain parts omitted;

FIGS. 2 and 3 illustrate the working profile of two embodiments of the control finger forming part of the system disclosed;

DESCRIPTION OF THE PREFERRED EMBODIMENTS

Figure 4:
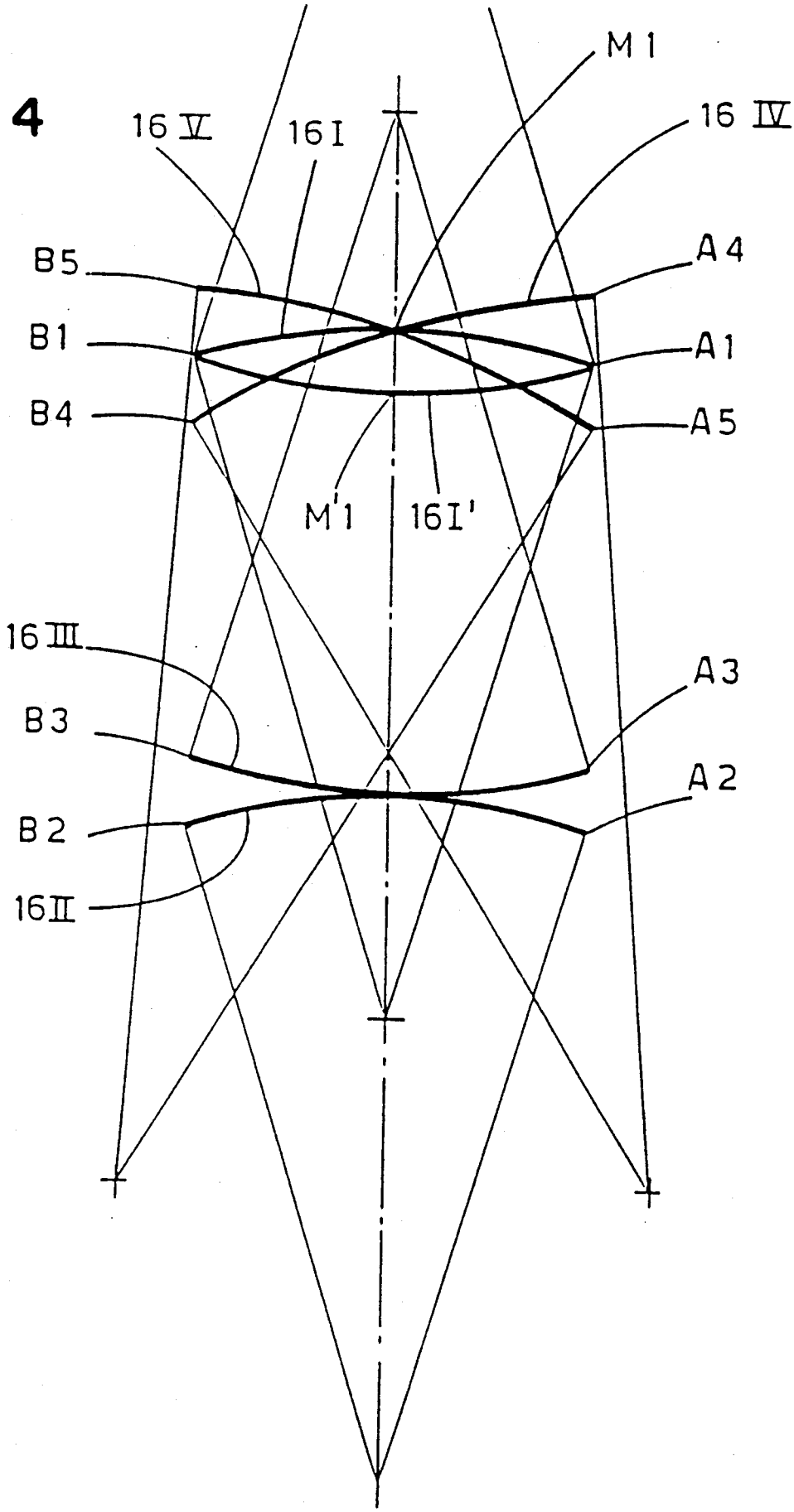
FIG. 4 shows six possible trajectories through which it is possible to shift the center of rotation of the finger illustrated in FIGS. 2 and 3.

Referring to FIG. 1 which illustrates the part of an engine that incorporates the camshaft 7, the valve timing system according to the invention consists in a plurality of moving control fingers 1 allocated one to each valve 9.

The finger 1 is located between the cam 3 on the one hand, and on the other, a generously proportioned flat surface 4 associated directly or indirectly with the stem end of the relative valve 9.

The engine illustrated in FIG. 1 has an overhead type camshaft 7, and the flat surface 4 is one and the same as the uppermost surface of a bucket tappet 5 fitted over the stem 11 of the valve 9. Needless to say, the system disclosed is by no means restricted to overhead cam engines, but can be applied equally well to engines with push-rod and rocker type valve operating gear, in which case the flat surface 4 will be offered by the end of the push-rod, i.e. the end impinged upon by the relative cam 3.

Similarly, the flat surface 4 need not necessarily be associated with just one inlet or exhaust valve 9 per cylinder, but where the design envisages four or more valves 9 per cylinder, with each of the single valves.

The finger 1 shifts substantially in a longitudinal direction, in relation to its own axis, and in the embodiment illustrated is carried and operated by a shaft 6, disposed parallel to the camshaft 7, via a relative lever arm 14 associated rigidly with the shaft 6, and pivotably with the finger 1.

The single lever arms 14 of the system are identical in embodiment and disposed mutually parallel, such that the centers 2 about which the single fingers rotate all coincide with a common rectilinear axis lying parallel to the camshaft 7.

15 denotes means by which to generate movement such as will produce a rotation of the shaft 6 in either direction about its own longitudinal axis. The exact purpose of such means 15 is to invest the fingers 1 with a movement that causes their relative centers of rotation 2 to be displaced together through a given straight or curved trajectory 16. The means 15 in question, as shown in FIG. 1, consist in a rod 17 hingedly connected to the lever arm 14 on the one hand, and on the other, to a lead nut denoted 18. The lead nut 18 is paired threadedly with a screw 19 disposed substantially parallel to the stems 11 of the valves 9 and carried by a bracket 20 mounted rigidly to the engine 21; the screw 19 in turn is freely rotatable in either direction, and driven by conventional means not illustrated in the drawings. Thus, when the nut 18 is moved along the screw 19, the shaft 6 rotates, the centers of rotation 2 of the fingers 1 shift in the corresponding direction, and the fingers 1 themselves are displaced through a substantially longitudinal path.

The movement and shape of the fingers 1 are such that the contact produced with the cams 3 and the flat surfaces 4 will occur unfailingly through lines lying parallel to the camshaft 7. More exactly, the profile of the single finger 1 exhibits an initial section that increases in width, at least through a given stretch departing from the end lodged between the relative cam 3 and the flat surface 4, and a terminal section the profile of-which is such as to restore tip clearances that may become affected by movement of the finger.

The surfaces of the finger 1 offered to the cam 3, on the one side, and to the flat surface 4 on the other, are dissimilar; the profile denoted 1a, which is offered to the cam 3, consists in at least one curve, whereas the profile denoted 1b, offered to the flat surface 4, consists in one or more curves of differing radius.

In a preferred embodiment of the finger 1, the first profile 1a will consist in a curve, denoted 12, and a flat stretch denoted 13, merged together, whereas the second profile 1b will exhibit either one curve, or two or more curves of dissimilar radius. The flat stretch 13 of the first profile 1a is located at the end of the finger 1 nearest the shaft 6, and lies substantially: parallel to the flat surface 4 of the tappet 5.

Numerous possibilities exist for the embodiment of the first profile 1a; the curve denoted 12 might be circular, elliptical or parabolic, or alternatively, ogival as in FIG. 2, or flanked by flat stretches 13 and 14 on either side, as in FIG. 3. Similarly, the second profile 1b might be circular, elliptical, parabolic, or composite.

All such variations of the two profiles 1a and 1b are within the scope of the invention, provided that the section beyond the stretch of increasing width is designed in such a way as to ensure that nominal clearances, modified by the lever action of the finger 1, can be restored; in effect, the essential feature of the invention is the location of the moving finger 1 between the cam 3 and the flat surface 4, whilst any variations in profile of the finger are dictated simply by the type of engine and/or the performance characteristics it is wished to obtain.

The non-active part of the finger 1, that is, the section adjacent to the lever arm 14, can be of any given shape provided that it does not obstruct the movement of the cam 3. Whilst in FIG. 1, for example, the section in question is bent upwards, such that the center of rotation 2 of the finger 1 is located above the plane occupied by the flat surface 4, the center 2 could equally well be located either below or substantially coincident with this same plane. In a preferred embodiment of the system, the leading flank 10 of the cam 3, considered in relation to its direction of rotation, will exhibit a rounded rather than a flat profile, to the end of ensuring that acceleration is transmitted to the relative valve 9 gently rather than suddenly.

Turning now to the practical results obtainable from the system disclosed, FIG. 4 illustrates a number of different trajectories 16 described by the centers of rotation 2 of the fingers 1, and FIGS. 5–8 are relative graphs showing the lift characteristics of the valves 9 assuming, for the sake of simplicity, that the trajectories 16 reflect the shape of arc to a circle, and in the case of the finger 1, that the that the initial curve 12 of the first profile 1a, and the second profile 1b, are both arcs to circles. The embodiment of the finger 1 is as in FIG. 1, i.e. with the first profile 1a appearing as a curve 12 merging into a flat stretch 13.

In the graphs of FIGS. 5–8, the 'A' axis denotes the degree of lift induced in the valves 9, and the 'G' axis the angular position of the cam. The curves reflect two different positions of the respective finger 1, and more exactly, throughout FIG. 4 and FIGS. 5–8, A1–A2–A3–A4–A5 and B1–B2–B3–B4–B5 denote the two limit positions of the fingers 1 and the corresponding lift characteristics of the valves 9, respectively.

Figure 5:
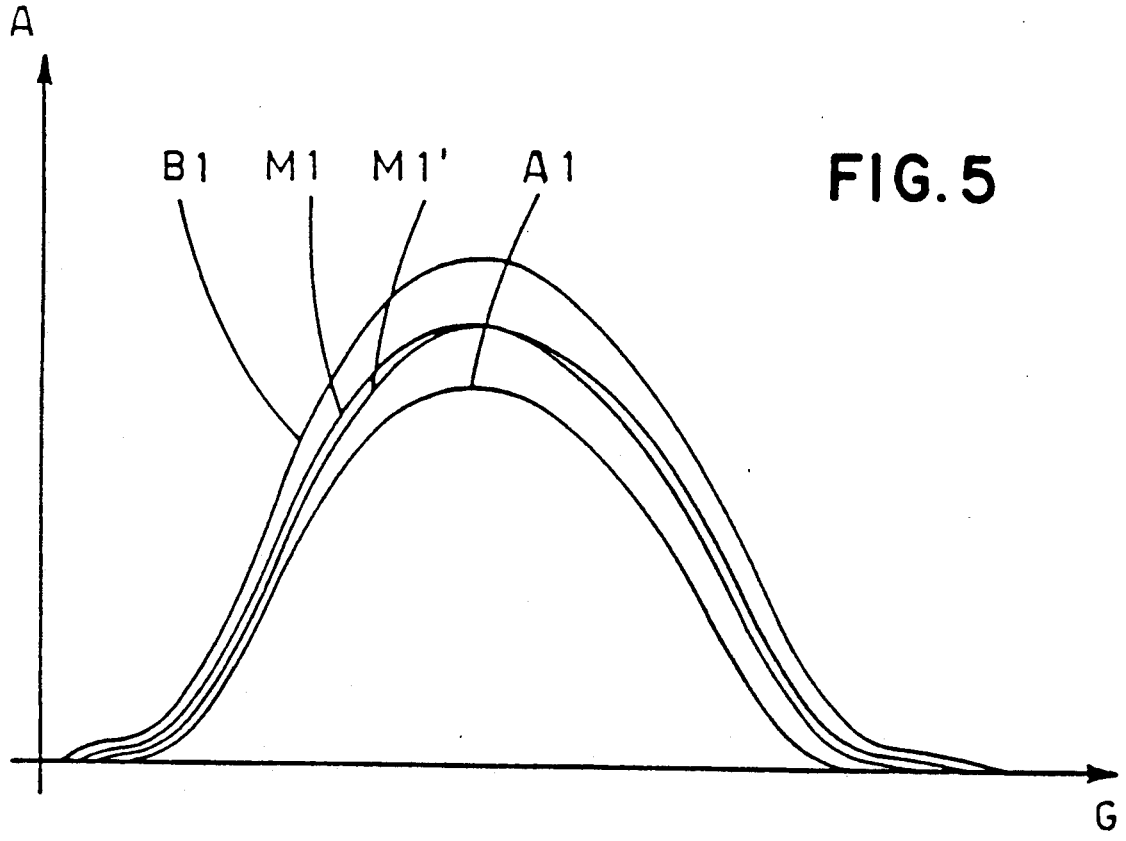
FIGS. 5 to 8 are graphs illustrating different valve timing curves obtainable with the system disclosed, where the 'A' axis reflects the degree of lift, and the 'G' reflects the angular position of the cam.

Comparing the curves A1 and B1 in FIG. 5, it will be seen how lift increases when the relative finger 1 is moved from position A1, in which its tapered end lies between the cam 3 and the flat surface 4, to position B1, in which the section of greatest width occupies this same position.

Figure 6:
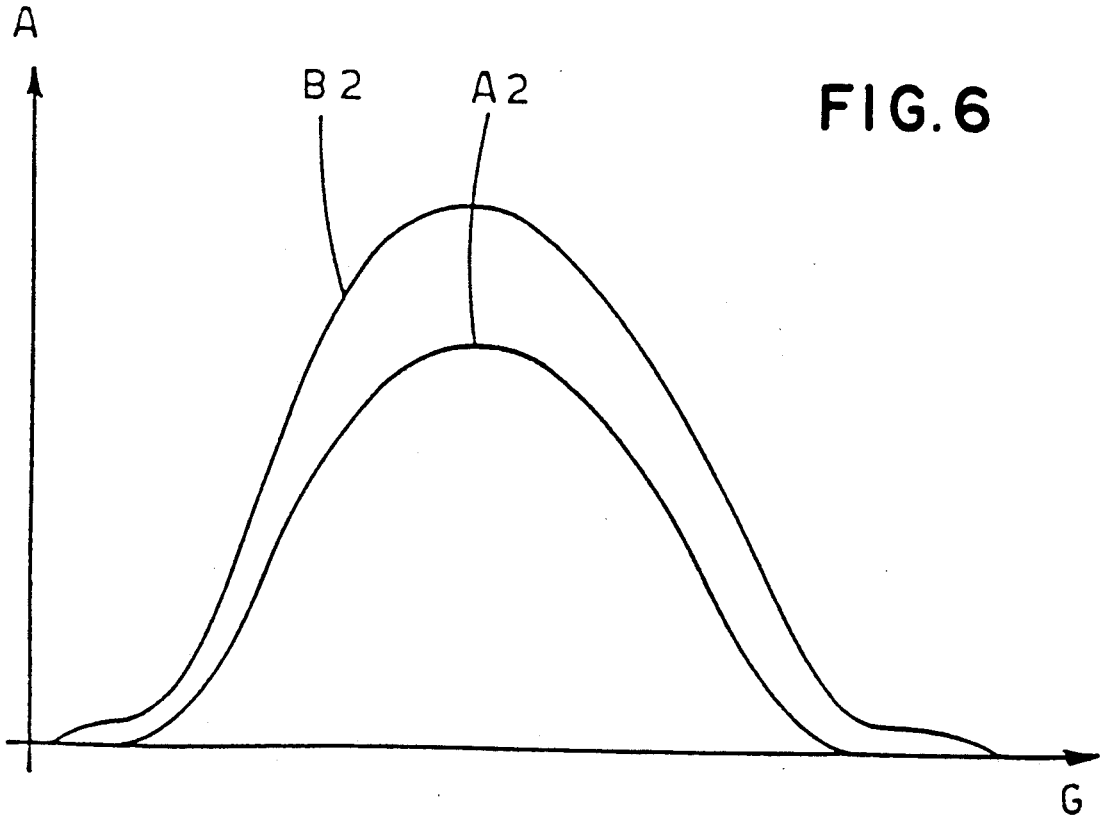

Likewise in FIG. 5, M1 and M1' denote the lift curves relative to intermediate positions between A1 and B1 produced by shifting the center of rotation 2 of a finger 1 as in FIG. 1 along a trajectory 16I which is complementary to that denoted 16I'. The essential difference between the two curves M1 and M1' is the slight advance, 2°–3° approximately, of the former. In FIG. 6, the two curves A2 and B2 are obtained by moving the center of rotation 2 through a trajectory 16II substantially the same as that denoted 16I, but lowered to the point of lying essentially tangential to the plane occupied by the flat surface 4; in this instance, the center of rotation 2 of the finger 1 lies substantially within the plane containing the flat stretch 13 of the first profile 1a. It will be seen that there is a notable increase in the height of the curve at center, and a greater difference between the curves produced at minimum lift A2 and maximum lift B2.

Figure 7:
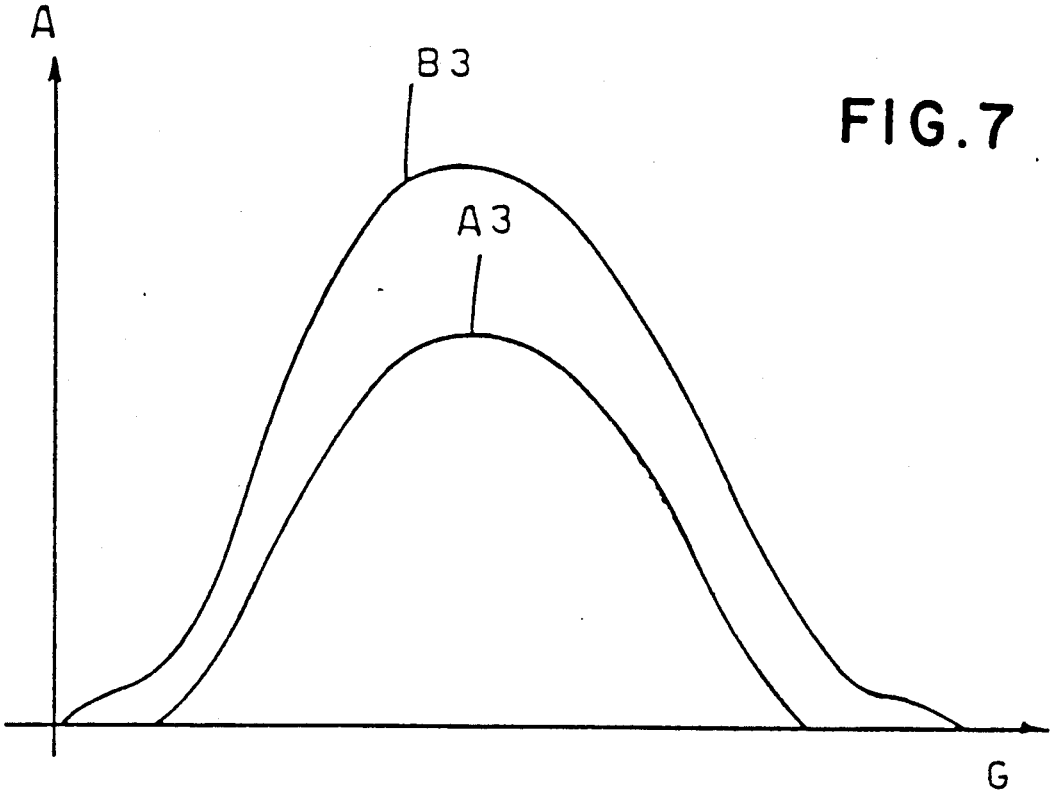
Figure 8:
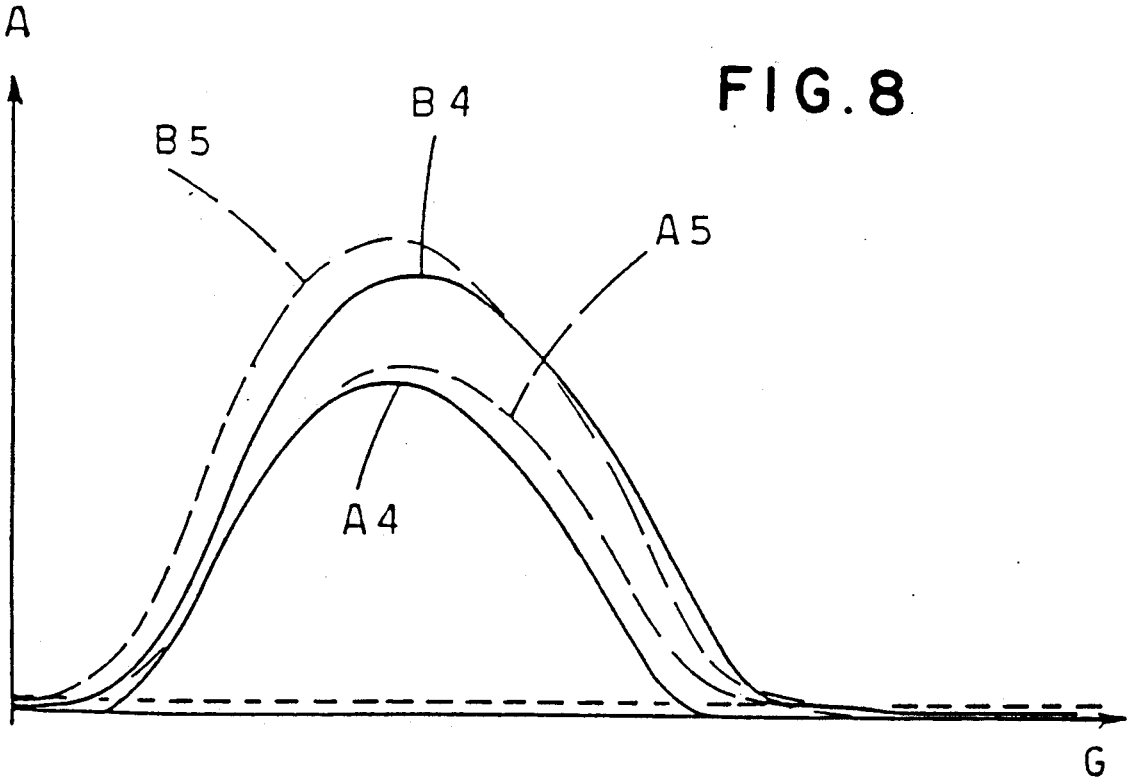

The curves A3 and B3 of FIG. 7 are obtained by taking the center of rotation 2 through a trajectory 16III that is complementary to and tangential with the trajectory denoted 16II. Comparing these curves A3 and B3 with those denoted A2 and B2, it will be seen that the rise of the maximum lift curve B3 and the fall of the minimum lift curve A3 are much advanced, and that maximum lift is considerably increased. In FIG. 8, the curves denoted A4 and B4 are obtained moving the center of rotation 2 of a finger 1 as in FIG. 1 through the trajectory denoted 16IV in FIG. 4, which intersects 16I at M1 and is similarly disposed with its concave side downward, though directed away from the engine, with respect to a vertical plane. Compared to curves A1 and B1 in FIG. 5, these curves A4 and B4 exhibit no clearances (to be restored by modifying the adjustment), and are characterized by a particularly smooth take-up, a less noticeable difference in rise, a greater difference in fall, and increased acceleration on the rise.

FIG. 8 also illustrates two curves A5 and B5 relative to a trajectory denoted 16V in FIG. 4, which is the inverse of 16IV considered in relation to a straight line passing through M1 and M1'. Compared to curves A4 and B5, it will be seen that A5 and B5 are more similar through the fall; also, with trajectory 16V, one has an advance on the opening flank and a retard on the closing flank, reflecting the opposite to that which occurs with 16IV.

Evidently, by modifying the lift characteristic, one produces a variation in the volumetric efficiency, maximum power and maximum torque characteristics of an engine. According to the invention, appropriate modification of the lift curve is effected simply by altering the position of the finger 1 to shift it further forward or back between the relative cam 3 and the flat surface 4 of the tappet or push rod; in the case of the preferred embodiment illustrated, this is achieved by rotation of the screw 19 in one direction or the other.

It is essential that the flat surface 4 between the L finger 1 and the end of the tappet or push rod be generously proportioned, in order to ensure that the relative movement of the two components will not be affected by excessive friction, or by snagging. The screw 19 might be operated manually, or by means (not illustrated) that comprise a CPU and would be capable of instructing the appropriate movement of the fingers 1 to suit load conditions and running speed of the engine.

Thus, by appropriate selection and proportioning of the profiles offered by the cams 3 and fingers 1, expedient plotting of the trajectories described by the fingers' centers of rotation 2, and suitable adjustment of the valve tip clearances, it becomes possible to fit the system disclosed to any given type of engine, or pump, or compressor, whether of overhead camshaft or push-rod and rocker design. Similarly, the ultimate embodiment of the means 15 by which the fingers 1 are operated is entirely a matter of choice, and might be totally different from that illustrated in FIG. 1.

As regards obtaining a desired lift characteristic, it will be clear enough that if the direction of rotation of the camshaft 7 is reversed, or if the fingers 1 are mounted on the opposite side of the valve to that shown in FIG. 1, the relative curve in FIGS. 5–8 will be inverted; such an expedient might serve in the selection of exhaust valve settings, as well as in optimizing the adaptation of the system disclosed to different types of engine.

We claim:

1. A variable valve timing system for internal combustion engines, comprising:

a movable control finger disposed between a relative cam and a flat surface, said flat surface in cooperation with a valve, said finger having a cam surface, and having a valve surface substantially parallel to said cam surface, a shaft having a longitudinal axis parallel to a cam shaft, said shaft being arranged and constructed to control the position of said finger with respect to said relative cam and said flat surface, said cam surface of said finger being engageable with said relative cam, said valve surface of said finger being engageable with said flat surface, said finger having a first profile section, a second profile section, a third profile section, and a fourth profile section, said first section disposed at a distal end of said finger, said first section arranged and constructed such that the distance between said cam surface of said finger and said valve surface of said finger generally increases away from said distal end, said second profile section disposed adjacent said first profile section and exhibiting a generally increasing distance between said cam surface of said finger and said valve surface of said finger, said cam surface being substantially a flat surface and said valve surface being substantially a cylindrical surface, said third profile section disposed adjacent said second profile section and exhibiting a generally decreasing distance between said cam surface of said finger and said valve surface of said finger, each cam surface being substantially a flat surface and said valve surface being substantially a cylindrical surface, said fourth profile section connected to said shaft, said fourth profile section disposed adjacent said third profile section and exhibiting a generally decreasing distance between said cam surface of said finger and said valve surface of said finger, whereby adjustment of the position of said finger alters the relationship between the relative cam and the flat surface.

2. A system according to claim 1, wherein the rate of change in the distance between said cam surface and said valve surface of said second profile section differs from the rate of change in the distance between said cam surface and said valve surface of said third profile section.

3. A system according to claim 1, wherein a leading flank of said relative cam exhibits a rounded profile, whereby acceleration is transmitted gently through said finger to said valve.

4. A system according to claim 1, further comprising a processing unit, said processing unit arranged and constructed to control movement of said finger in response to varying load and engine conditions.

5. A system according to claim 1, wherein a trajectory of said finger is disposed above a plane described by said flat surface.

6. A system according to claim 1, wherein a trajectory of said finger is disposed below a plane described by said flat surface.

7. A system according to claim 1, wherein a trajectory of said finger is disposed substantially coincident with a plane described by said flat surface.

* * * * *